US005479912A

United States Patent [19]

Dunne

[11] Patent Number: 5,479,912

[45] Date of Patent: Jan. 2, 1996

[54] SPACE HEATING APPLIANCES

[75] Inventor: Simon Dunne, Birmingham, United Kingdom

[73] Assignee: Ambi-Rad Limited, Halesowen, United Kingdom

[21] Appl. No.: 277,957

[22] Filed: Jul. 20, 1994

[30] Foreign Application Priority Data

Jul. 20, 1993 [GB] United Kingdom ..... 9315042

[51] Int. Cl.[6] ..... F24C 3/00

[52] U.S. Cl. ..... 126/91 A; 431/353; 237/70

[58] Field of Search ..... 126/91 A, 92 R, 126/360, 99 R; 431/353, 154, 352, 351, 186; 237/70; 34/233; 432/144

[56] References Cited

U.S. PATENT DOCUMENTS

| | | | |
|---|---|---|---|
| 1,244,864 | 10/1917 | Kemp et al. | 126/91 A |
| 2,887,074 | 5/1959 | Friedberg | 126/91 A |
| 3,999,306 | 12/1976 | Koch et al. | 34/233 |
| 4,619,604 | 10/1986 | Pickering | 126/91 A |
| 4,712,734 | 12/1987 | Johnson | 126/91 A |
| 4,731,015 | 3/1988 | Johnson | 126/91 A |
| 4,813,867 | 3/1989 | Yoshida et al. | 126/91 A |
| 5,315,940 | 5/1994 | Kasseck | 431/353 |

*Primary Examiner*—James C. Yeung
*Attorney, Agent, or Firm*—Learman & McCulloch

[57] ABSTRACT

Space heating appliance of the radiant tube type has sheet metal or other shield formations mounted in the tube to extend downstream of fan induced gas flow from side edges of the mouth of a fluid fueled burner head which projects into the tube to feed hot gases into the flow so as initially to separate that infeed from the general flow along the tube.

5 Claims, 2 Drawing Sheets

SPACE HEATING APPLIANCES

This invention relates to radiant tube space heating appliances of the kind comprising a radiation tube or duct, commonly suspended overhead in the space to be heated, a fan or other pump for inducing flow of gases along the duct in use, and one or more fluid fuelled burner assemblies, typically gas fired and automatically controlled, for feeding hot gases into the flow. Radiant heat is emitted from the duct surface and this is commonly directed and concentrated, e.g. in a downward direction, by reflectors mounted adjacent to the duct. Such appliances are hereinafter referred to as "radiant tube heating appliances".

BACKGROUND OF THE INVENTION

Examples of known constructions of radiant tube heating appliance are described in EP-A-0248629 and in EP-A-2102555 and also in our co-pending application GB 9300612.0 filed 14 Jan. 1993.

The object of the invention is to provide improvements in radiant tube heating appliances giving better efficiency, more reliable operation, and, in particular, substantially reduced levels of noxious emissions.

SUMMARY OF THE INVENTION

According to the invention there is provided a radiant tube heating appliance as hereinbefore defined including a burner head mounted in use to project laterally inwardly of the radiation duct into the path of flow therethrough and having a burner mouth at the front of the head facing downstream of said path of flow whereby fuel mix is operatively discharged along said flow for combustion in the duct immediately downstream of the head; A shield formation or formations are operatively mounted within the radiation duct with its or their upstream end or ends adjoining or in close proximity to at least each side of the burner mouth and extending downstream therefrom at least in a substantial part of the zone in which are said combustion takes place in use whereby the flow of gases along the duct past the head is substantially separated from the flow of fuel mix issuing from the duct in the zone.

Conveniently, where the burner mount is straight sided, for example as described in our application 9300612.0, a pair of substantially rectangular flat sheet shield formations made typically of stainless steel, are mounted in spaced parallel relationship to extend downstream from the side edges of the burner mouth.

In a radiation duct of circular cross section where the burner head depends vertically into the duct the formations will lie on spaced vertical chords of the cross section leaving segmental through passages to either side.

However, it is to be understood that other forms and shapes of shield formation or formations may be used e.g. to suit particular shapes of burner head or mouth. Thus a burner head having a circular mouth could be provided with a cylindrical shield formation i.e. the latter may take the form of a burner tube mounted within the radiation duct.

THE DRAWING

An example of the invention is now more particularly described with reference to the accompanying drawings wherein FIG. 1 is a diagrammatic longitudinal vertical section of part of a radiant tube and burner assembly, and FIG. 2 is a vertical sectional view on line 2—2 of FIG. 1.

DETAILED DESCRIPTION

Figure 1:
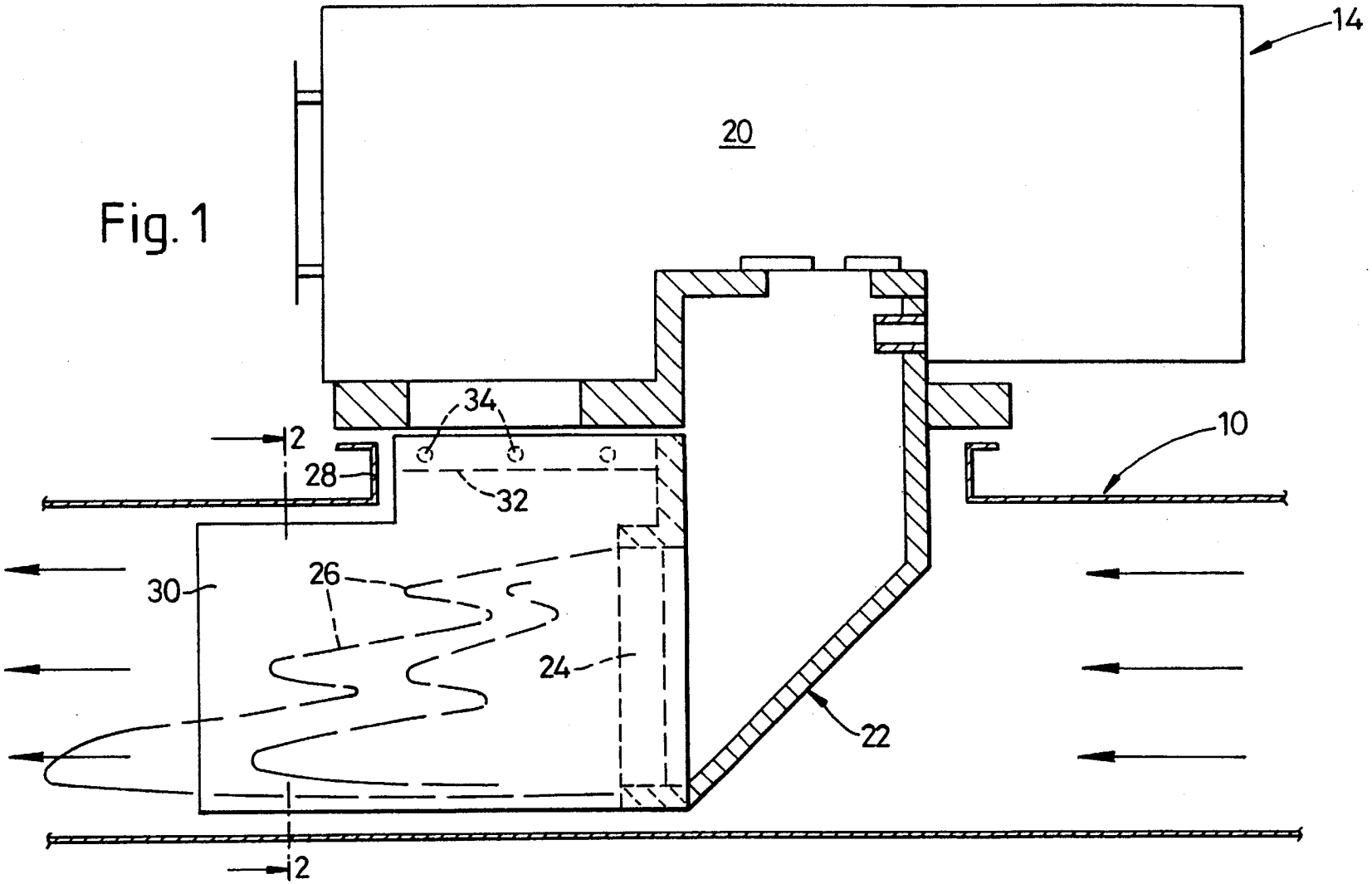

The radiant tube space heating appliance of this example is an installation for heating a large space such as a factory building or public hall: the overall installation is generally of conventional type comprising branched or other runs of circular section radiation tube 10 through which hot gases provided by burner assemblies 14 are drawn by an exhaust fan leading to a discharge flue. The fan and each burner assembly is controlled automatically in known manner.

This example includes burner assemblies 14 as described in detail in our co-pending application 9300612.0 which gives details of their construction and operation. Briefly each assembly comprises a control unit 20 mounted externally above tube 10 and a burner head 22 which depends downwardly through a top opening in the tube and has a rectangular burner mouth 24 on a vertical diametral plane of tube 10 and directed downstream of the direction of flow through tube 10 (from right to left as viewed in FIG. 1). The longer axis of mouth 24 is vertical leaving substantial segmental spaces each side of head 22 for passage of said flow but, in this example, the lower horizontal edge of mouth 24 is in close proximity to the bottom of the tube.

In use a mix of gas fuel and air is projected from mouth 24 for combustion within tube 10, burning taking place as a flame directed downstream and approximately in the zone indicated by the wavy broken lines 26 in FIG. 1.

In known constructions, for example as in our above co-pending application, problems arise due to reduced efficiency and over-production of noxious emissions, notably CO due to chilling of the flame arising from its direct contact with the passing through flow of gases along tube 10 which will be relatively cool by the time they reach the respective burner head 22. The first burner head at the upstream end of a particular run or leg of tube 10 will be subjected to cold carrier air admitted at the end vent and burner heads downstream along the line are subjected to gases which have been heated by the upstream burner or burners but which have then been substantially cooled in their passage along tube 10 as the whole object is to emit maximum heat into the surrounding space.

The chilling of the flame by this direct contact has an adverse effect on combustion, rendering it much less efficient than is possible in theory and giving much higher CO emission than would otherwise be the case. Much higher standards aimed at reduction of atmospheric pollution are now being imposed by law in many countries for equipment of this type and many of the known designs of radiant tube heating appliance are incapable of operation to meet these new standards often due to the problem of flame chilling.

In the present example the assembly includes a pair of shield formations 30. Each formation is a flat metal plate, substantially rectangular in shape, typically of stainless steel and provided with a return flange 32 along an upper extension which projects into a collar 28 of tube 10 on which the burner assembly 14 is mounted, said flange being secured by bolts 34 or other appropriate fastening means to the collar structure.

Figure 2:
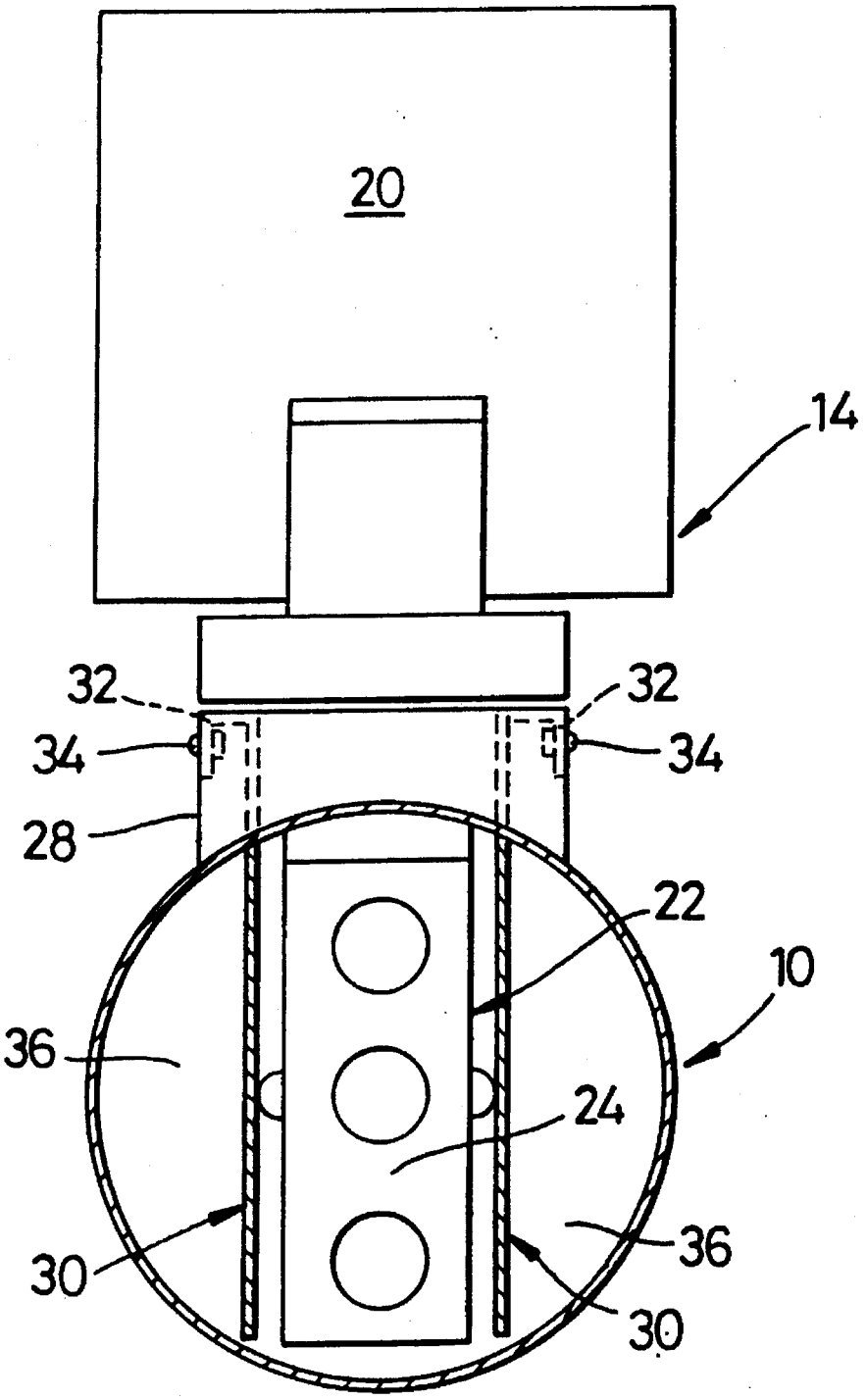

The formations 30 are disposed in spaced parallel relationship with their upstream edges positioned close to the side faces of the burner mouth walls leaving only a small gap, and extending forwardly in the downstream direction along tube 10 over substantially the full zone in which combustion takes place. The upper and lower edges of each formation are in close proximity to the wall of tube 10 so that they define segmental passages 36 (FIG. 2) on either side containing the through flow along tube 10. This flow can only mix with the products of combustion issuing from head 22 downstream of said combustion zone. As the formations 30 are themselves heated by the flame there is little or no chilling effect in the combustion zone so providing much more efficient operation, improved flame stability, and, more importantly, a very substantial reduction in noxious emissions notably CO bringing the latter well below the maximum allowable under the most exacting standards presently contemplated.

The increased efficiency gives improved heat output and hence more economical operation.

The shield formations 30 are simple to manufacture and easy to instal, they can readily be adapted to existing patterns of burner assemblies and heating appliances and the preferred method of their mounting and attachment as described above simplifies assembly and maintenance. The burner assembly 14 can be simple mounted and dismounted as before, the front face of head 22, i.e. the structure surrounding mouth 24 being simply slotted vertically between the pair of formations 30 which are attached to the tube structure. The formations themselves can readily be dismounted for repair or replacement.

It is contemplated that the performance of existing installations may be substantially improved by fitting a shield formation or formations of the invention and the latter further contemplates a method of improving performance and reducing noxious emissions and pollutants in a radiant tube space heating appliance by providing a shield formation or formations described above.

I claim:

1. Radiant tube space heating apparatus comprising;

a radiant tube providing a flow path for gases;

means for inducing a flow of gases through said tube along said path;

a combustion burner device having a tubular burner head that projects laterally into said radiant tube and terminates at a mouth facing downstream of the flow of said gases, said burner mouth having a pair of flat sides spaced laterally from said radiation tube to allow said gases to flow therebetween along said path, said combustion burner device including means for introducing a combustible fuel mix into said burner head and means for heating said fuel mix sufficiently for combustion within a combustion zone located downstream of said burner mouth;

and shield means extending downstream from said combustion mouth substantially coextensive with said combustion zone for substantially shielding said fuel mix from exposure to said flow of gases during passage through said combustion zone, said shield means comprising a pair of flat plates supported within said tube in spaced parallel relation to said flat plates and said tube.

2. The apparatus of claim 1 wherein said plates are formed of stainless steel.

3. The apparatus of claim 1 wherein said tube has a substantially circular cross section and said flat plates are arranged as chords of said circular cross section defining segmental through-passages for said gases in the space between said plates and said tube.

4. The apparatus of claim 1 wherein said shield means is supported within said tube independently of said burner device to enable selective demounting and removal of said burner device from said tube apart from said shield means.

5. The apparatus of claim 4 wherein said shield means is supported by said tube.

* * * * *